US008007125B2

(12) United States Patent
Schevardo et al.

(10) Patent No.: US 8,007,125 B2
(45) Date of Patent: Aug. 30, 2011

(54) METHOD FOR CHANGEOVER BETWEEN MIXED LIGHT COLORS

(75) Inventors: Dirk-Achim Schevardo, Kainsbach (DE); Peter Younes, Höchstadt (DE); Markus Weissmann, Höchstadt (DE)

(73) Assignee: Diehl Aerospace GmbH, Überlingen (DE)

( * ) Notice: Subject to any disclaimer, the term of this patent is extended or adjusted under 35 U.S.C. 154(b) by 346 days.

(21) Appl. No.: 12/266,831

(22) Filed: Nov. 7, 2008

(65) Prior Publication Data

US 2009/0122532 A1 May 14, 2009

(30) Foreign Application Priority Data

Nov. 9, 2007 (DE) ..... 10 2007 053 480
Nov. 21, 2007 (DE) ..... 10 2007 055 670

(51) Int. Cl.
*F21V 9/10* (2006.01)

(52) U.S. Cl. ..... 362/231; 362/85
(58) Field of Classification Search ..... 362/231, 362/85, 233, 552, 601; 315/312
See application file for complete search history.

(56) References Cited

U.S. PATENT DOCUMENTS 7,354,172 B2 * 4/2008 Chemel et al. ..... 362/231
2006/0176693 A1 8/2006 Walter et al.

FOREIGN PATENT DOCUMENTS

DE 10 2006 055 615 A1 4/2006
DE 10 2004 047 669 A1 10/2007

* cited by examiner

*Primary Examiner* — Sharon Payne
(74) *Attorney, Agent, or Firm* — Scully, Scott, Murphy & Presser, P.C.

(57) ABSTRACT

A transition from one mixed color to another, the target color locus (Z) in a color system such as e.g. the standard chromaticity diagram (CT), is effected along a stored path (pi) from a succession of color loci which avoids undesired color mixing regions. A change between target color loci (Z) is effected from an instantaneously attained color locus (A0) by transition to an adjacent color locus in that path of the stored paths (pi) which leads as closely as possible past the instantaneous color locus (A0) and which then avoids undesired color mixing regions on the way to the notified target color locus (Z).

2 Claims, 2 Drawing Sheets

METHOD FOR CHANGEOVER BETWEEN MIXED LIGHT COLORS

BACKGROUND OF THE INVENTION

1. Field of the Invention

The present invention relates to a method for implementing a changeover between mixed light colors whose color loci can be specified in a color system, such as the CIE standard chromaticity diagram, by means of predetermining desired value sequences to a color control loop.

2. Discussion of the Prior Art

Such a method is known from DE 10 2004 047 669 A1 (in particular in connection with FIG. 6 therein). According to this document, light sources of the three primary colors red, green and blue, the three so-called primary valences, are energized independently of one another and their color emissions are additively mixed. Light sources such as lasers, electroluminescence elements, organic LEDs or in particular semiconductor light-emitting diodes are preferably used since their brightness is approximately linearly dependent on the duty ratio of the feeding with pulse-width-modulated constant current pulses. In the CIE standard chromaticity diagram depicted schematically therein, the resultant mixed light color locus is determined essentially by means of the instantaneous brightness contribution of each individual one of the three primary colors. This color locus can accordingly be displaced via at least one of the three brightness contributions and, as a result, each mixed light color can be set within a color triangle which is inscribed in the standard chromaticity diagram and whose corner points are given by the individual color emissions of the three light sources used for the illumination. The actually instantaneous contribution of the individual primary colors is measured by spectral colored light sensors as actual value transmitters of a controller. The controller alters the respective intensity of the emission by means of the duty ratio of the energization of the individual light sources in order to correct a possible instantaneous deviation from a predetermined mixed color, that is to say from the desired value of the color locus in the color triangle.

A mixed light color locus can thus be varied by variably predetermining the three primary color intensities as desired values to the controller. This change is manifested as a shift in the mixed-color light towards that one of the three primary colors whose brightness is increased in relation to the other two. The brightness is altered by way of the duty ratio of the energization of the respective colored light source. A continuous change in the duty ratio therefore brings about a change from an instantaneously given initial color locus to an intended target color locus in continuous transition through the various intervening color locus regions in the standard chromaticity diagram. Therefore, in the transition from one color locus to the next, mixed colors can occur whose visual impression is physiologically undesirable or even disturbing, especially if the color locus change extends over relatively long time spans. By way of example, in the background lighting of a theatre scene or in the lighting program for an aircraft passenger cabin it would be extremely unpleasant if, in the transition from dark-blue night light to red-dominant morning light, crimson color locus regions were also traversed, since the latter do not occur at all in the sunlight spectrum but lie in the direct mixture transition from the blue to the red colors. Less disturbing, by contrast, would be an intensity driving sequence such that a mixed color transition between blue B and red R takes place across the yellow Y color locus region. Switching off the previous color emission and switching on the future emission would be perceived as even more disturbing for lack of a gradual transition. On the other hand, for reasons of complexity it would be unrealistic to define, with respect to every actually conceivable pairing of initial and target color loci, the driving relations for all color mixtures which are possible during a gradual transition, which, under certain ambient conditions, are intended indeed not to appear, in order to be able for instance to mask out these color locus regions prior to their occurrence and to replace them by other color mixtures.

SUMMARY OF THE INVENTION

With knowledge of these conditions, the present invention is based on solving the technical problem of performing color locus changes without disturbing transitional color effects.

This object is achieved according to the invention by means of the essential features specified in the main claim. Accordingly, there are stored in a desired value memory different paths from successive color loci between a respective pair of initial and target color loci, which are typically assigned to specific environmental settings; such as during operation on stage, for example, to the slowly controlled transition from day to night background lighting or between different drama scenes; or, in the case of aircraft passenger cabin lighting, to the transition between different operating states such as boarding taxi, takeoff, security announcement, cruise, inflight entertainment, meal, sunset, sleep, sunrise, meal, cruise, landing and deboarding. These standardized stored paths always pass through the respective color space (that is to say e.g. the color mixture triangle in the standard chromaticity diagram) in such a way that undesired mixed-color regions are avoided for the respective transition from the initial to the target color locus.

If a changeover is then intended to be made from a currently given initial color locus (which can be predetermined in a steady-state fashion or just be reached along a path) to a target color locus which does not lie in the course of a path just traversed, then, in accordance with one preferred development of the present invention, on the part of the present sequence of desired value stipulations at the controller, a changeover is made to future following of that one of the stored paths which, on the one hand, leads past the instantaneous initial color locus as closely as possible and, on the other hand, leads as closely as possible to the notified new target color locus in order thereby once again to avoid a direct transition between the two color loci through color locus regions with undesired color mixtures.

This ensures that no disturbingly coarse color alteration occurs during the changeover to a new target color locus with the initial color locus being left, and no undesired mixed colors occur after the changeover to a path to the new target color locus. This is because, in order to head for the new target color locus, an abrupt change of color mixtures does not occur since the most appropriate path passing the closest layer to the instantaneous initial color locus is taken whose color locus sequence that has already been stored in an optimized manner avoids undesired color locus regions.

BRIEF DESCRIPTION OF THE DRAWINGS

The forgoing solution to the problem attained according to the invention is now illustrated in more specific detail on the basis of the exemplary realization depicted schematically in the drawings, in which.

DETAILED DESCRIPTION OF THE INVENTION

Figure 1:
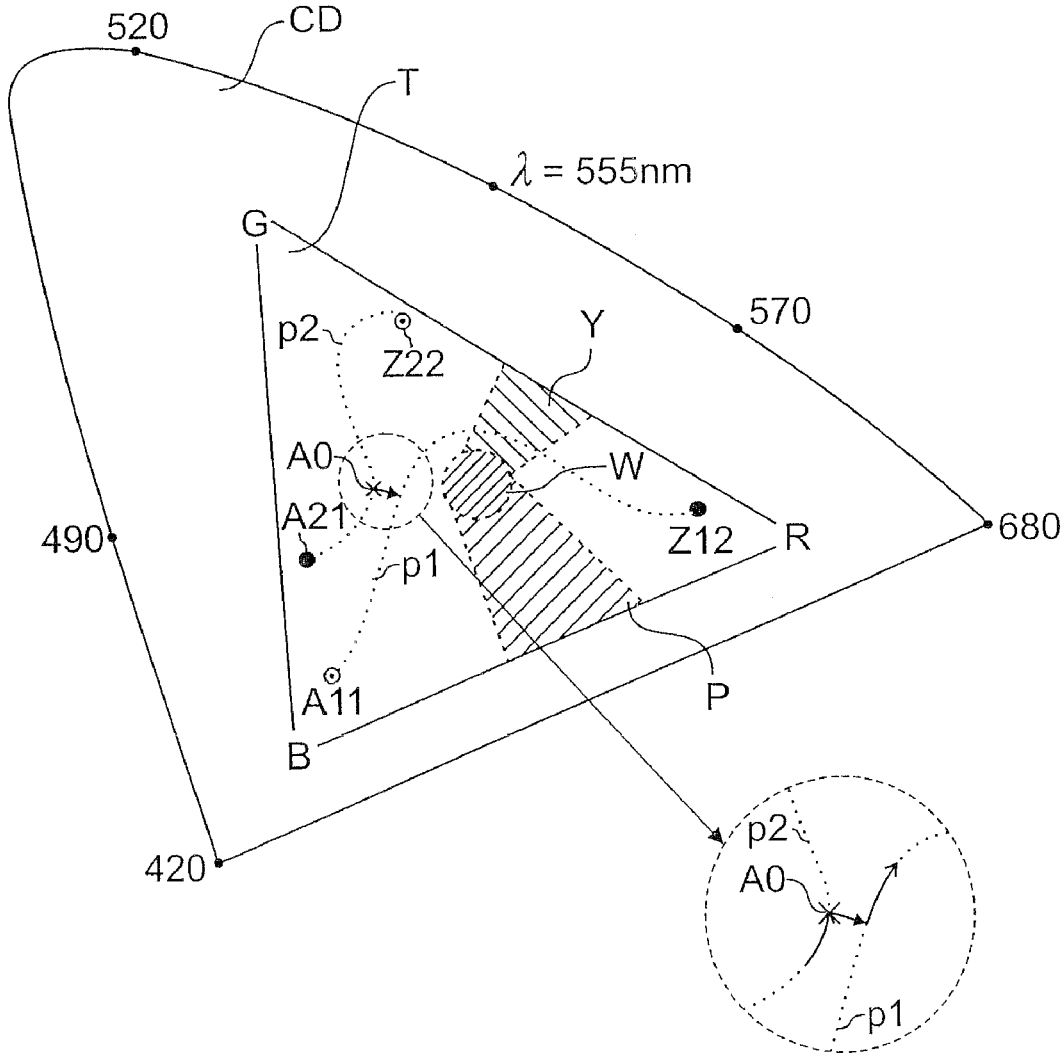
FIG. 1 shows color locus paths in the color triangle inscribed into the standard chromaticity diagram in the overview, and the transition from an initial color locus to a path passing adjacent in the detail excerpt.
Figure 2:
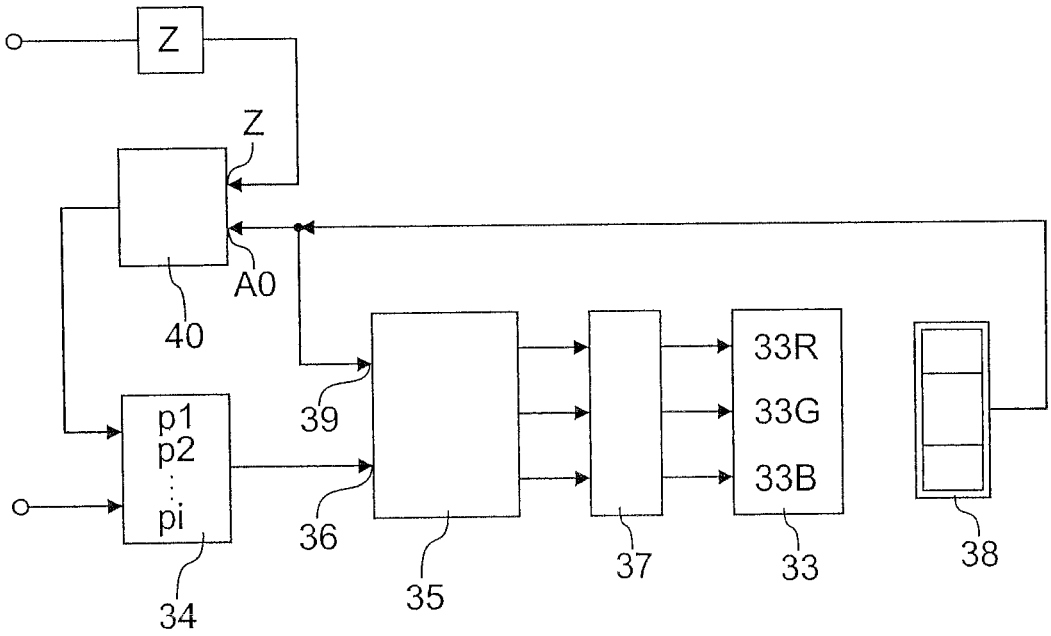
FIG. 2 shows, in a highly abstracted block diagram, the driving of a switchable color locus controller for the transition to one of predetermined paths on the occasion of a change in the target color locus.

The color emissions red R, green G and blue B from three individually intensity-controllable light sources 33 R, 33 G and 33 B, in particular LEDs, are entered into the standardized chromaticity diagram CD in FIG. 1. These color loci R, G, B determine the corners of a color triangle T situated within this standard chromaticity diagram. All the mixed colors situated in the triangle T can be set by means of individual intensity drivings of the three colored light sources 33 R, 33 G and 33 B. In this case, in order to simplify the illustration a constant total brightness was taken as a basis for this schematic diagram, that is to say it was not taken into account that the diagrams shrink at lower brightnesses.

In order to pass, for example, from a deep blue night lighting corresponding to the initial color locus A11 in FIG. 1 to red-dominated morning light as the target color locus Z12, without traversing the intervening color regions crimson P and achromatic (white) W in the course of this color change, a path p1 from a succession of color loci which avoids the undesired regions W and in particular P is stored in a memory 34.

Another stored path p2 may lead from an initial color locus A21 in the blue-green region via deep green regions to a target color locus Z22 in the light green region with a weak yellow contribution, in the vicinity of the light wavelength lambda=555 nm, at which the sensitivity of the human eye is the greatest.

Thus, many paths pi having very different courses between also different initial and target color loci A-Z are stored in the memory 34.

The color locus—currently retrieved from the memory 34—in the course of such a path pi is fed to a controller 35 as triple desired value 36 for the three primary colors R, G, B. The controller 35 correspondingly modulates the colored light sources 33 via pulse width modulators 37. A three-channel spectrally sensitive color sensor 38 serves as actual value transmitter 38 of the control loop, said sensor supplying an actual value 39 for each of the three primary colors R, G, B to the controller 35 in order to enable correction of a possible instantaneous desired-actual deviation in the intensities of each of the emissions of the three primary colors R, G, B.

It is assumed that a color locus change along the path p2 from the initial color locus A21 towards the notified target color locus Z22 has just reached the color locus A0 when for some reason a decision is made actually not to move to the target color locus Z22 along the path p2, but instead to a color locus in the red region—but in turn whilst avoiding the undesired crimson region P and whilst avoiding the achromatic region W. For this purpose, a selection circuit 40 is then used to choose from the stored supply of paths pi that one which firstly avoids said regions P/W and secondly traverses the red region R; or—even better—even has its target color locus Z lying in it; and which, moreover, passes the instantaneously attained color locus A0 with the greatest possible proximity in order that only a color locus change that is as slight as possible occurs during the change to the future path p2→p1.

This is checked by the selection circuit 40 established in tabular fashion, for example, it being ascertained that, in the exemplary case depicted schematically in FIG. 1, the stored path p1 best meets the criteria for the path change at the color locus A0 currently attained; this is because it leads closely past the color locus A0 and it ends in the red region near R. Therefore, the present desired value 36 of the controller 35 is changed over from the instantaneously attained color locus A0 to the color locus adjacent to it in the path p1, the color loci of which henceforth deliver the desired values 36 for the controller 35 until the target color locus Z12 thereof has been reached via this new path p1.

The method according to the invention is not restricted to the exemplary embodiment described and can accordingly be applied e.g. also when using other, different-colored or more or fewer light sources and also any other method of driving the light sources.

In order to change over between target color loci Z in an arbitrary color system (such as e.g. in the standard chromaticity diagram CT), that is to say between different mixed colors, a change is thus made from the instantaneously attained initial color locus A0 to a color locus adjacent to it in the course of a stored path pi from successive color loci which leads as closely as possible past the present initial color locus A0 and which then avoids undesired color locus regions on the way to the notified target color locus Z.

What is claimed is:

1. A method of operating a lighting unit having light sources of different color emissions, where a color control loop controls changeover between mixed light color whose color loci are specified in a color system, the method comprising:

storing, in memory, a plurality of predetermined selectable paths respectively defining a course of successive color loci in the color system, each path running from an initial color locus to a target color locus while avoiding undesired color locus regions;

selecting, using a selecting circuit, a first path from said plurality of predetermined selectable paths;

feeding the first path to the control loop;

operating the lighting unit via the control loop to emit light according to successive color loci along the course of successive color loci of the first path, wherein if the target color locus associated with the first path is changed to a new target color locus situated off the first path, the method further comprises:

selecting, using the selecting circuit, a second path from said plurality of predetermined selectable paths, which passes substantially adjacent to a current color locus at the time of changing the target color locus, and which leads substantially adjacent to or directly to the new target color locus whilst avoiding undesired color locus regions;

determining, a color locus on the second path to switch to which is closest to the current color locus at the time of changing, where a color locus change between said first path to said second path is minimized;

changing a color locus to said determined color locus on the second path; and operating the lighting unit via the control loop to emit light according to successive color loci along the course of successive color loci of the second path.

2. The method of operating a lighting unit according to claim 1, wherein said color system is a CIE standard chromaticity diagram.

* * * * *